US009206799B2

(12) United States Patent
Lilie et al.

(10) Patent No.: US 9,206,799 B2
(45) Date of Patent: Dec. 8, 2015

(54) MOUNTING ARRANGEMENT FOR A RESONANT SPRING IN A LINEAR MOTOR COMPRESSOR

(75) Inventors: Dietmar Erich Bernhard Lilie, Joinville (BR); Rinaldo Puff, Joinville (BR)

(73) Assignee: Whirlpool S.A., São Paulo-Sp (BR)

( * ) Notice: Subject to any disclaimer, the term of this patent is extended or adjusted under 35 U.S.C. 154(b) by 578 days.

(21) Appl. No.: 13/520,394

(22) PCT Filed: Dec. 20, 2010

(86) PCT No.: PCT/BR2010/000443

§ 371 (c)(1),
(2), (4) Date: Nov. 9, 2012

(87) PCT Pub. No.: WO2011/082461

PCT Pub. Date: Jul. 14, 2011

(65) Prior Publication Data

US 2013/0121855 A1 May 16, 2013

(30) Foreign Application Priority Data

Jan. 5, 2010 (BR) ..... 1000181

(51) Int. Cl.

| | |
|---|---|
| ***F04B 35/04*** | (2006.01) |
| ***F04B 9/06*** | (2006.01) |
| ***F04B 53/00*** | (2006.01) |
| ***F04B 53/22*** | (2006.01) |
| ***F04B 53/14*** | (2006.01) |

(52) U.S. Cl.

CPC ..... *F04B 53/004* (2013.01); *F04B 9/06* (2013.01); *F04B 35/045* (2013.01); *F04B 53/147* (2013.01); *F04B 53/22* (2013.01)

(58) Field of Classification Search

CPC ..... F04B 35/045; F04B 9/06; F04B 53/004; F04B 53/147; F04B 53/22

USPC ..... 417/357, 361, 416, 418

See application file for complete search history.

(56) References Cited

U.S. PATENT DOCUMENTS 3,007,625 A * 11/1961 Dolz ..... 417/416
3,143,281 A * 8/1964 Dolz ..... 417/416

(Continued)

FOREIGN PATENT DOCUMENTS

GB 902184 A 7/1962
WO WO 2009/076734 * 6/2009 ..... F04B 39/12
WO WO-2009076734 A1 6/2009

OTHER PUBLICATIONS

International Search Report and Written Opinion dated May 19, 2011. International Application No. PCT/BR2010/000443.

*Primary Examiner* — Bryan Lettman
*Assistant Examiner* — Timothy P Solak
(74) *Attorney, Agent, or Firm* — Dinsmore & Shohl LLP

(57) ABSTRACT

The compressor of the invention comprises: a block with a cylinder; a movable assembly formed by a piston reciprocating in the cylinder and coupled to an actuating means by a rod; and a resonant spring having a first and a second diametrical end portion which are attached to the movable assembly by a first fixation means (MF1) and, to the block, by a second fixation means (MF2) which is adjustably attached to the block and to said second end portion so as to affix the latter to the block in a position defined along the displacement of the resonant spring in three directions orthogonal to one another and defined by the direction of the axis of the resonant spring, by the diametrical direction of the second end portion and by the diametrical direction orthogonal to said two first directions, and also along the angular displacement of said second end portion around said three directions orthogonal to each other.

13 Claims, 6 Drawing Sheets

(56) References Cited

U.S. PATENT DOCUMENTS 4,179,630 A * 12/1979 Stuber ..... 310/15
4,721,440 A * 1/1988 Hurst ..... 417/371
4,854,833 A 8/1989 Kikuchi et al.
7,185,431 B1 * 3/2007 Seagar et al. ..... 29/888.02
2003/0183794 A1 10/2003 McGrath et al.
2009/0280015 A1 * 11/2009 Lillie et al. ..... 417/416

* cited by examiner

MOUNTING ARRANGEMENT FOR A RESONANT SPRING IN A LINEAR MOTOR COMPRESSOR

FIELD OF THE INVENTION

The present invention refers to a mounting arrangement for a resonant spring in a compressor of the type driven by a linear motor and, more particularly, to a mounting arrangement for a resonant spring of the type which couples a compression movable assembly, that is, a piston-rod-actuating means assembly, to a non-resonant assembly generally defined by a cylinder block affixed in the interior of a compressor shell.

PRIOR ART

As exemplarily illustrated in FIG. 1 of the enclosed drawings, the compressors, generally used for refrigeration and driven by an electric motor of the linear type, comprise a shell 1, generally hermetic and which houses a non-resonant assembly including a block 10 which can be mounted in the shell 1 by means of suspension springs 11, such as for example, helical springs.

The block 10 incorporates a cylinder 12 in whose interior is defined a compression chamber 13, having an end 13*a* generally closed by a valve plate 14 and by a head 25, and an open opposite end 13*b* through which is mounted a piston 20 reciprocating in the interior of the compression chamber 13. The piston 20 is coupled, generally by means of a rod 30, to an actuating means 40 which carries magnets 41 energized by the linear motor M which is mounted to the block 10.

The linear motor M is responsible for generating the necessary drive to displace the piston 20 in the interior of the compression chamber 13 of the cylinder 12 and, consequently, for compressing the refrigerant fluid in the form of gas.

To the movable assembly, defined by the piston, the rod and the actuating means, is coupled a resonant spring 50 mounted in a manner to exert opposite axial forces on the piston 20, upon its reciprocating axial displacement in the interior of the compression chamber 13. The resonant spring 50 operates as a guide for the axial displacement of the piston 20, further actuating on the compression movable assembly together with the linear motor M of the compressor. The compression movable assembly and the resonant spring define the resonant assembly of the compressor.

In the prior art construction, exemplified in FIG. 1, the resonant spring 50 presents a helical shape having a first and a second end portion 50*a*, 50*b* that are defined by diametrically disposed spring extensions, said end portions being respectively attached to the compression movable assembly (generally to the actuating means 50) by a first fixation means MF1 and, to the non-resonant assembly, for example to the block 10 or to the supporting structure thereof, by a second fixation means MF2.

In this type of construction, as illustrated in FIG. 1 of the enclosed drawings, each first and second fixation means MF1, MF2 comprises a base portion b1, b2, which is rigidly attached to the movable assembly and to the non-resonant assembly, respectively, and a cover portion t1, t2 to be screwed against the respective base portion b1, b2, for retaining, between said base portion b1, b2 and cover portion t1, t2, respectively, the first and the second end portion 50*a*, 50*b* of the resonant spring 50. The base and cover portions are configured to define respective sleeve portions defining concave cradles for the seating of the diametrical end portions 50*a*, 50*b* of the resonant spring 50. This type of mounting arrangement presents some drawbacks, such as the possibility of occurring gaps and the requirement of precise dimensioning, that is, with reduced manufacturing and mounting tolerances.

In the type of mounting arrangement illustrated in FIG. 1, it is not possible to carry out a longitudinal dimensional adjustment of the resonant assembly, that is, of the distance between the top of the piston 20 and the valve plate 14 during the mounting of the compressor. It is not also possible to carry out any rotational adjustment of the resonant assembly around the axis of the resonant spring 50. It is only possible, before the final tightening of the screws, to effect an adjustment by linearly and angularly displacing the end portions of the resonant spring 50, in the diametrical direction orthogonal to the axis of the spring and around the axis of said end portions 50*a* of the spring 50.

Thus, in said prior art mounting arrangements, the dimensioning and mounting of the parts defined by the piston 20, the rod 30, the actuating means 40 and the resonant spring 50, are required to be made with strict tolerances, which are of complex and expensive execution to guarantee two mounting conditions considered fundamental for the correct operation of the compressor and which can be defined as follows:

- firstly, the position of the top of the piston in relation to the valve plate, in the mounting condition, for allowing the piston to approximate, as much as possible, the valve plate in the upper dead point condition, that is, in the compression stroke end condition, in order to minimize the dead volume of refrigerant gas in the interior of the compression chamber and, thus, to minimize the efficiency losses of the compressor; and
- secondly, the alignment of the piston in relation to the cylinder, in order to minimize the loading on the bearing (oil or pneumatic).

However, for obtaining the correct distance from the top of the piston to the top of the cylinder, during the mounting process, there is a chain of small tolerances to be maintained, so that the final tolerance of the mentioned distance remains within acceptable levels.

Moreover, for obtaining the correct alignment of the piston in relation to the cylinder, it is necessary to maintain the same low levels for the tolerances orthogonal to the main axis of the compressor. This implies high manufacturing costs for the involved components.

The piston 20 is coupled to the actuating means 40 so as to allow the transfer of forces therebetween and the displacement of the piston 20, according to an axial direction coincident with the axis of the compression chamber 13, so as to minimize the transversal reaction forces of the block 10 against the piston 20. Such transversal reaction forces of the block 10 against the piston 20 can provoke excessive friction between the piston and the cylinder block, leading to: an increase of energy consumption, with consequent reduction of the efficiency of the compressor; an accelerated wear of the components subject to greater friction levels, reducing the useful life of the compressor; and the presence of noise due to the friction.

The problems mentioned above make desirable an arrangement for mounting the parts defined by the piston, the rod, the actuating means and the cylinder block which guarantees, by means of component parts with relatively larger manufacturing and assembly tolerances, the alignment of the piston to the axis of the cylinder, as well as a correct positioning of the top of the piston in relation to the valve plate, in the mounting or stationary condition of the piston.

A solution for said difficulties in mounting the resonant spring in a linear compressor is proposed in the Brazilian Patent Application PI 07055541-2, of the present applicant.

According to said prior art solution, the resonant spring has a first end portion affixed to the cylinder block of the compressor by a first fixation means, and a second end portion affixed to a movable assembly defined by the piston, the rod and the actuating means, by a second fixation means.

In said previous construction, at least one of the first and second fixation means comprises: a bearing portion previously affixed, by a first side, around one of the end portions of the resonant spring and having, on an opposite side, a fixation face; and a bearing receiving portion previously attached, by one side, to one of the parts of cylinder block and of movable assembly, and having, on an opposite side, a junction face. Said fixation and junction faces of the bearing portion and bearing receiving portion of the fixation means are seated and fused to each other, so as to attach the respective end portion of the spring to one of the parts of movable assembly and of cylinder block, maintaining said movable assembly concentric to the cylinder and in a predetermined axial positioning.

Although allowing, by means of a simple construction of low complexity, a correct positioning of the piston in the interior of the cylinder, without requiring small tolerances for the involved parts, this known solution presents the inconveniences of using plastic materials, to be thermally fused to each other and which present flexibility or elastic deformation when subject to compression forces, allowing undue amplification of the forces actuating on the resonant spring and unbalances in the excitation of the latter.

Other inconvenience in using plastic material is the need of applying especial and costly materials to reduce the elasticity of the fixation means and maximize its resistance to aging by thermo-chemical deterioration. Even using especial plastics, this prior art solution still faces the issue of providing a reliable mounting arrangement for the whole useful life of the compressor.

SUMMARY OF THE INVENTION

In view of the inconveniences mentioned above, the present invention has the generic object of providing a mounting arrangement for a resonant spring in a linear compressor, of the type considered above and which allows using component parts with a relatively simple construction and assembly, without requiring very strict tolerances for obtaining a correct centralized positioning of the piston in the interior of the cylinder and a resistant and reliable mounting arrangement for the whole useful life of the compressor, without interfering in the operational characteristics of the resonant spring.

The present invention has also the object of providing a mounting arrangement, such as cited above and which is capable of guaranteeing, upon mounting the piston to the cylinder, a predetermined distance between the top of the piston and the valve plate, so as to guarantee an adequate volumetric capacity for the compressor.

Other object of the present invention is to guarantee a correct positioning of the magnets (41) in relation to the motor (M) with an adequate concentricity in the two directions orthogonal to the displacement axis of the piston, and also angularly around said piston axis, allowing the magnets to be linearly displaced within the space between the laminations of the motor, without touching said laminations.

In order to comply with the objects cited above, the present invention provides a mounting arrangement for a resonant spring in a linear motor compressor of the type which comprises, in the interior of a shell: a block defining a cylinder; a movable assembly formed by a piston reciprocating in the cylinder, an actuating means and a rod coupling the piston to the actuating means; and a resonant spring having a first and a second end portion which are disposed according to a diametrical direction and attached, respectively, to the movable assembly, in a coaxial manner, by a first fixation means and, to the block, by a second fixation means.

It should be noted that, due to the manufacturing process of the resonant spring, its diametrical end portions are not mandatorily parallel to one another, since it is possible for an end portion to form an acute angle with the other.

According to the invention, the second fixation means is attached, with an adjustable relative positioning, to the block and to the second end portion of the resonant spring, so as to affix said second end portion to the block, in a position defined along the displacement of the resonant spring, in relation to the block, in three directions orthogonal to each other and defined by the direction of the axis of the resonant spring, by the diametrical direction of said second end portion, and by the diametrical direction orthogonal to said two first directions, and also along the angular displacement of the second end portion of the resonant spring around said three directions orthogonal to each other.

Considering the previous fixation of the resonant spring to the compression movable assembly, in a condition in which the axes of the two parts are coaxially maintained, the construction proposed for the mounting arrangement, particularly for the second fixation means, allows making the necessary alignment and axial positioning of the resonant assembly in relation to the cylinder of the compressor and to the motor, during the mounting of the latter.

The invention further provides a simplified construction for the first fixation means, which allows the first end portion of the resonant spring to be attached to the compression movable assembly, in a position defined along its relative displacement in the diametrical direction of said spring first end portion and around said direction, facilitating the coaxial alignment of the resonant spring with the compression movable assembly.

BRIEF DESCRIPTION OF THE DRAWINGS

The invention will be described below, with reference to the enclosed drawings, given by way of example of ways of carrying out the invention and in which.

DETAILED DESCRIPTION OF THE INVENTION

As already mentioned, the mounting arrangement for a resonant spring of the present invention will be described for a construction of refrigeration compressor driven by a linear motor.

Figure 1:
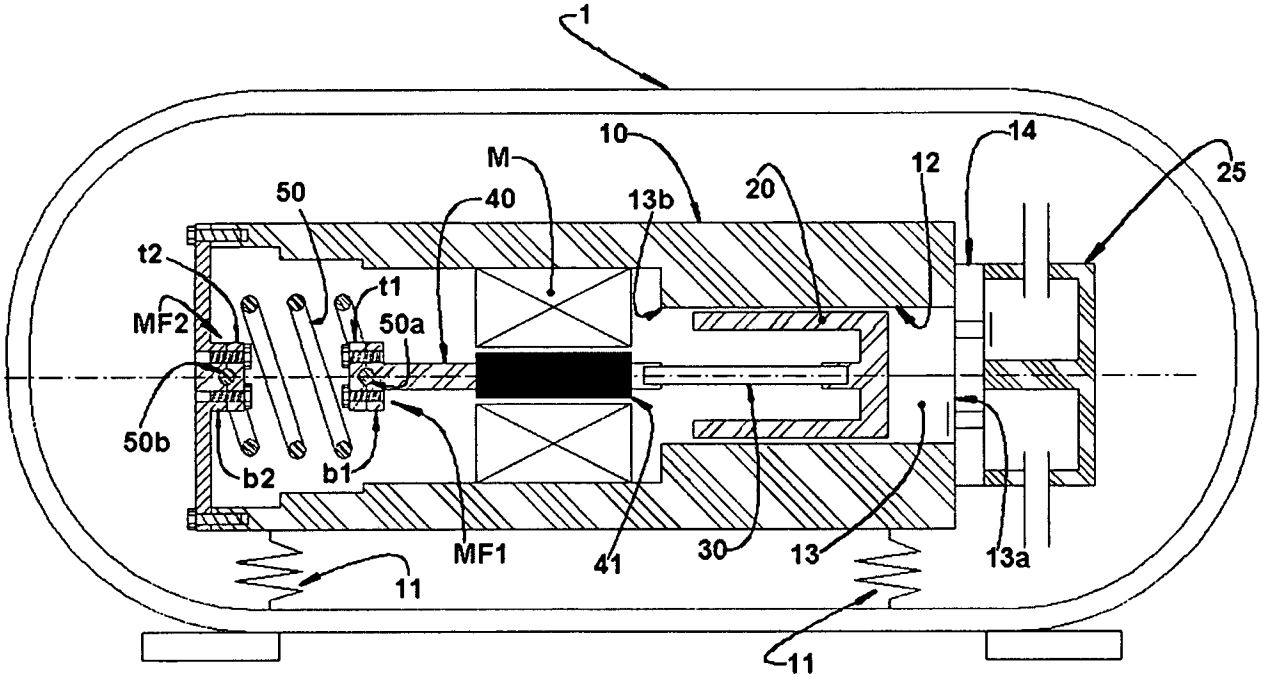
FIG.1 PRIOR ART
FIG. 1 represents a schematic and simplified longitudinal section view of a compressor driven by a linear motor and having a resonant spring mounted to the parts of assembly compressor and of non-resonant assembly, according to a prior art arrangement.
Figure 2:
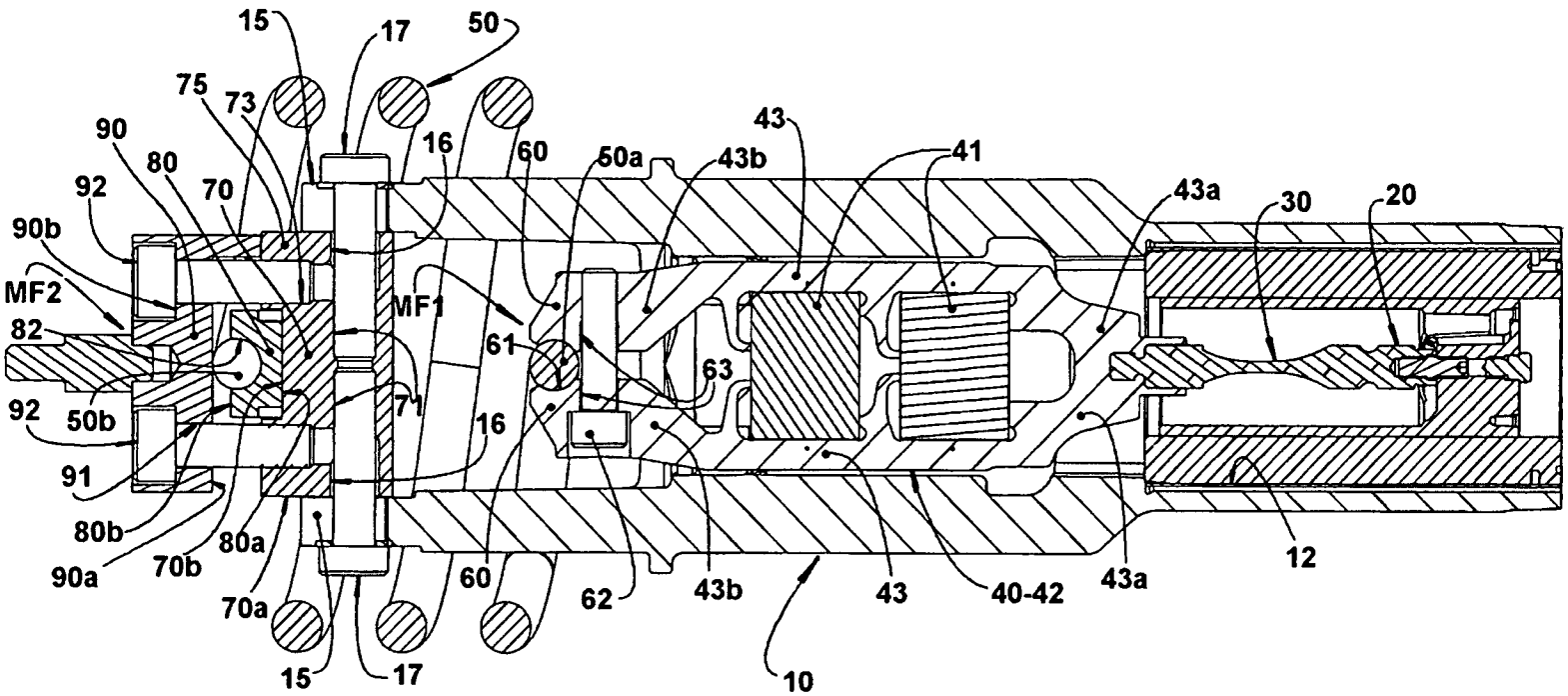
FIG. 2 represents a schematic and simplified longitudinal section view of a compressor of the type showed in FIG. 1, deprived of the shell but containing the mounting arrangement of the present invention.

As illustrated in FIG. 2, the refrigeration compressor to which is applied the mounting arrangement for a resonant spring of the present invention comprises, in the interior of a generally hermetic shell 1, the same basic components described at the introduction of the present specification for the linear motor compressor illustrated in FIG. 1, said common components being defined by the same reference numbers.

According to the illustrated construction, the resonant spring 50 presents a helical configuration formed by two interposed spring wires, with the same diameter and having their adjacent end portions coaxial to each other and disposed according to a diametrical direction orthogonal to the axis of the resonant spring 50, so as to define, jointly, the first and the second end portion 50*a*, 50*b* of the resonant spring 50. As previously mentioned, the two end portions 50*a*, 50*b* of the resonant spring 50 are not mandatorily parallel to one another, although maintaining a diametrical positioning in relation to the resonant spring 50.

According to the construction of the invention illustrated in FIGS. 2 to 6C, the first fixation means MF1 comprises two bearing portions 60, opposite to one another and each provided with a recess 61 configured to operate as a concave cradle, generally with a semi-circular profile, in the interior of which is partially housed a respective extension of the first end portion 50*a* of the resonant spring 50, said end portion being defined, in the illustrated construction, by the coaxial and adjacent ends of the two spring wires.

It should be understood that the resonant spring 50 can have one or both end portions 50*a*, 50*b* defined in an open manner, that is, by two spring wire coaxial extensions, or in a closed manner, with the respective spring wire coaxial extensions joined to each other by any coupling means.

The two bearing portions 60 are configured to embrace and secure, therebetween, the first end portion 50*a* of the resonant spring 50.

The two bearing portions 60 are incorporated to the actuating means 40 and associated with at least one tightening means 62, for example a screw, capable of moving and pressing one bearing portion against the other, one in relation to the other, by actuation of at least one tightening means 62 around the first end portion 50*a* of the resonant spring 50, retaining said first end portion 50*a* in the interior of the two mutually confronting recesses 61 of the two bearing portions 60.

In the illustrated construction, the two bearing portions 60 are incorporated, in a single piece, to the actuating means 40 which comprises a frame 42 in the form of a nipper with two arms 43, each having a base end 43*a* attached to the other arm 43 and a free end 43*b* which carries a respective bearing portion 60.

Each of the bearing portions 60 presents a hole 63, displaced in relation to the adjacent recess 61 and constructed to receive the tightening means 62 in the form of a screw, and one of the holes 63 can be internally threaded. The holes 63 of the bearing portions 60 are disposed according to the same axis orthogonal to the axis of the recess 61.

It should be understood that the two bearing portions 60 can be incorporated to the actuating means 40 in different manners, provided that they can be selectively displaced for allowing pressing one against the other around the first end portion 50*a* of the resonant spring 50, so as to affix the latter to the movable assembly.

Figure 3:
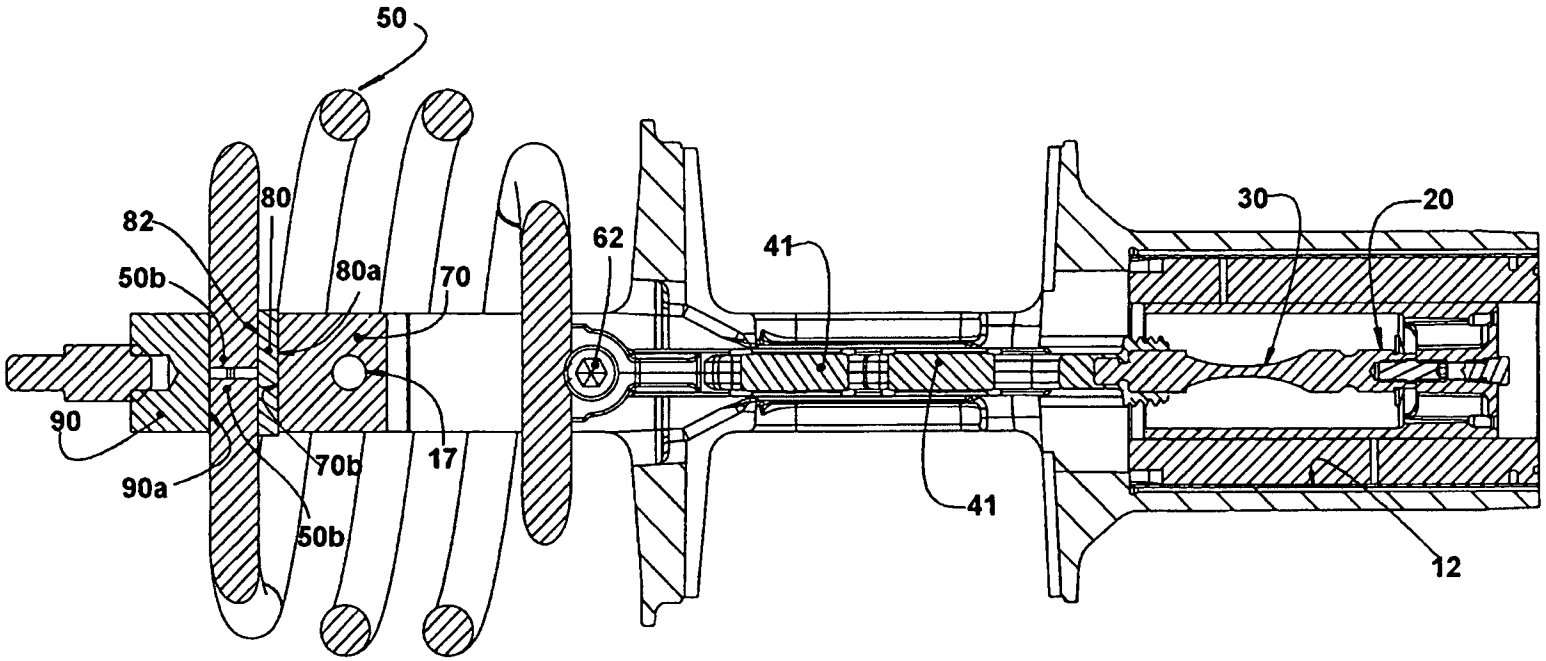
FIG. 3 represents a view similar to that of FIG. 2, but with the longitudinal section plane being offset by 90 degrees in relation to that of FIG. 2.
Figure 4:
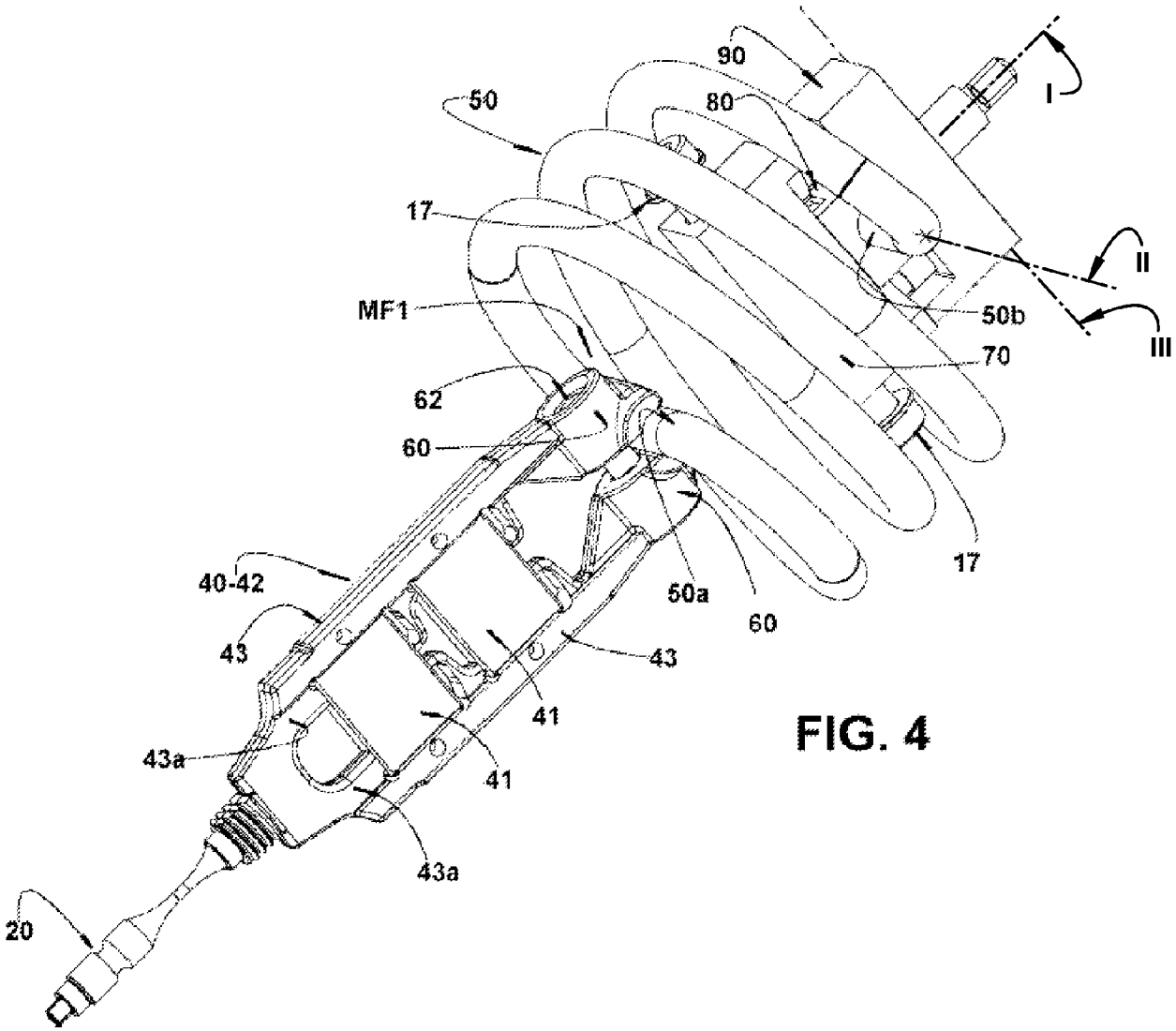
FIG. 4 represents a perspective view of part of the compressor showed in FIGS. 2 and 3, illustrating the resonant spring with its first end portion mounted to the first fixation means carried by the movable assembly.
Figure 5:
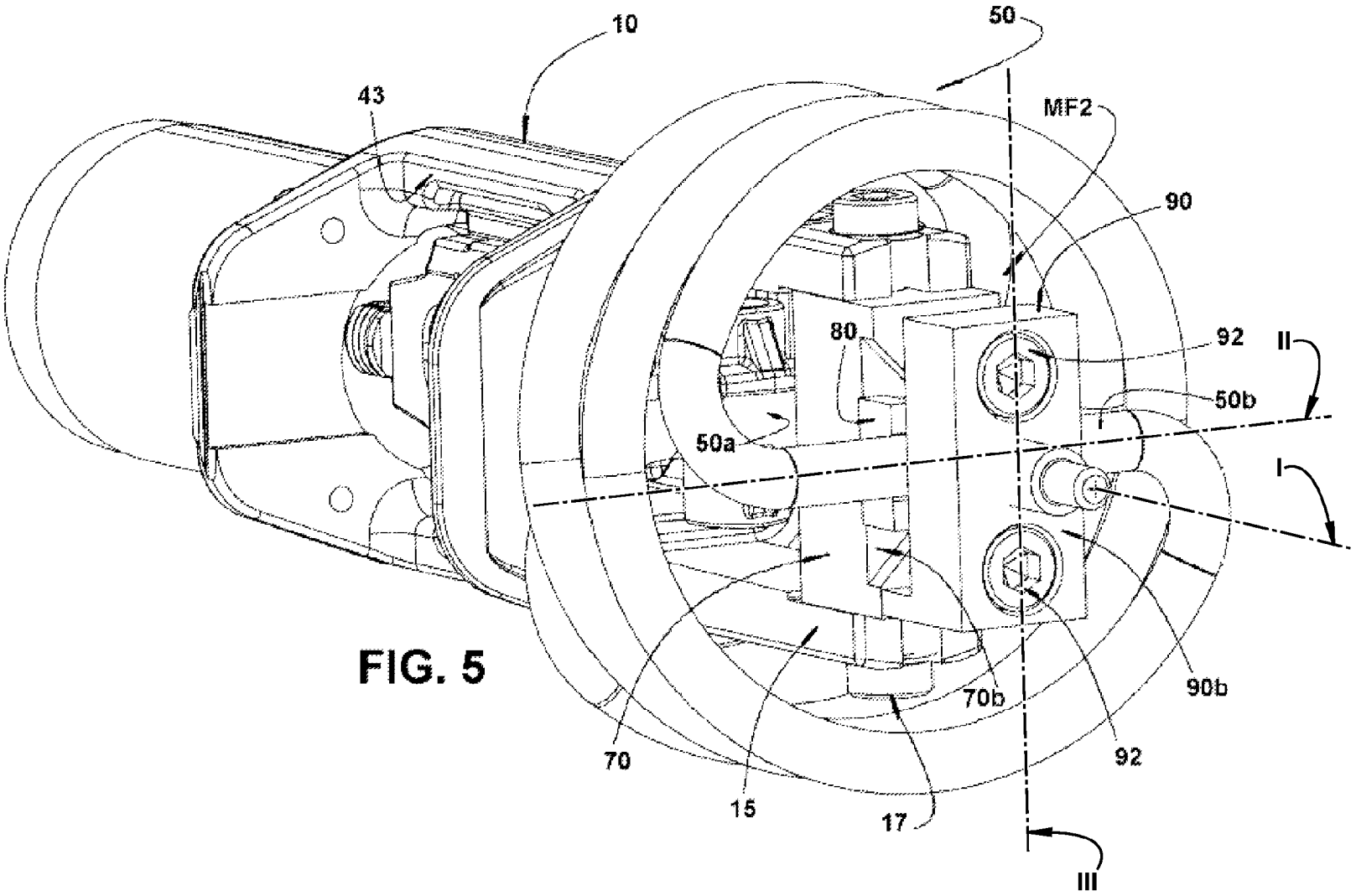
FIG. 5 represents a perspective view of other part of the compressor showed in FIGS. 2 and 3, illustrating the resonant spring with its second end portion affixed to the second fixation means already mounted to the block.
Figure 6A:
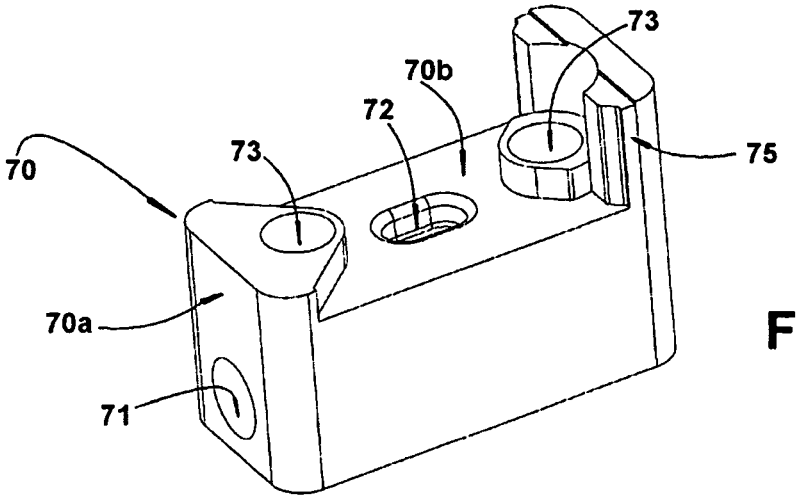
FIGS. 6A, 6B and 6C represent perspective views of the different component parts of the second fixation means illustrated in FIGS. 2, 3 and 5.
Figure 6B:
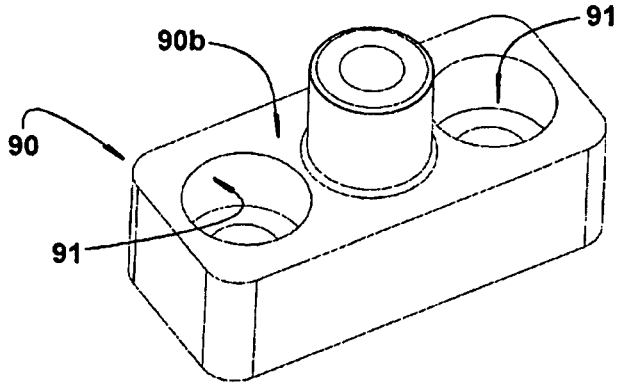
Figure 6C:
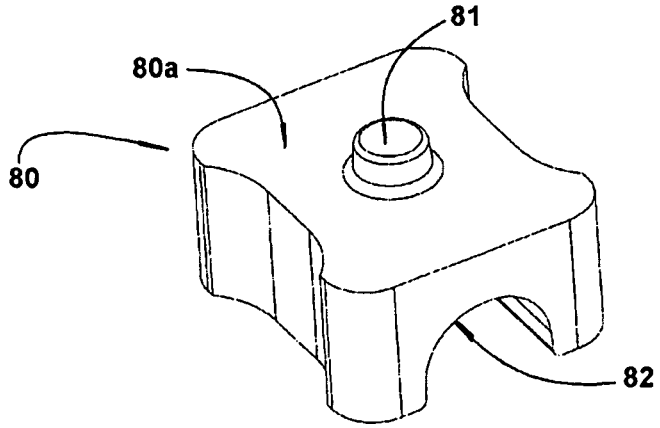

As illustrated in FIGS. 2, 3 and 4, the piston 20 is coaxially coupled, by the rod 30, to the end of the frame 42, in which said two arms 43 of the latter are attached to each other.

Also according to the type of construction illustrated in the drawings, the frame 42 of the actuating means 40 carries the magnets 41 which present the form of permanent magnets.

The construction proposed for the first fixation means MF1 allows the two bearing portions 60 to be defined in the frame 42 of the actuating means 40, considerably simplifying the formation of the first fixation means MF1 and permitting the first end portion 50*a* of the resonant spring 50 to be displaced, linearly, through the interior of the two bearing portions 60, before the final tightening of the latter, according to the diametrical direction of the axis of said first end portion 50*a*, as well as angularly, around said diametrical axis. Thus, the positioning of the first end portion 50*a* of the resonant spring 50 can be linearly and angularly adjusted during the mounting of the movable assembly, before the final compression of the tightening means 62, allowing easily obtaining the desired coaxial fixation of the resonant spring 50 to the actuating means 40, that is, to the compression movable assembly. It should be understood that the resonant spring 50 is constructed to have its end portions 50*a* and 50*b* diametrically and centrally positioned in relation to the axis of the resonant spring 50, but not necessarily parallel to one another.

In the preferred illustrated construction, the first and second end portion 50*a*, 50*b* of the resonant spring 50 are disposed coplanar to each other and according to directions orthogonal to the axis of the resonant spring 50. In this case, the bearing portions 60 have the axes of the recesses 61 also disposed orthogonally to the axis of the resonant spring 50, allowing that the linear adjustment of the positioning of the first end portion 50*a* of the spring be made according to a direction orthogonal to the axis of the resonant spring 50, and that the angular adjustment of said first end portion 50*a* be made by angularly displacing the resonant spring 50 around the axis of said first end portion 50*a*.

The actuating means 40 can have its frame 42 in the form of a nipper constructed in any adequate material such as, for example, cast aluminum alloy.

Further according to the invention, the second fixation means MF2 comprises a base body 70, an intermediate body 80 and a top body 90, coupling the second end portion 50*b* of the resonant spring 50 to the block 10 of the compressor and which can be constructed in any adequate material such as, for example, steel metal alloys or sintered material.

The base body 70 is dimensioned to have two opposite end faces 70*a* housed between the free ends of two longitudinal projections 15 of the block 10, which are diametrically opposite in relation to the contour of the cylinder 12. The free end of each longitudinal projection 15 of the block 10 is provided with a longitudinal slot 16, preferably with an open end, through which is attached a screw 17 whose body is screwed in the interior of a respective hole 71 provided in a confronting end face 70*a* of the base body 70, which also presents a front face 70*b*.

With the construction cited above, the base body 70 presents two holes 71 opposite and coaxial to each other, each receiving and retaining a respective screw 17 mounted through the longitudinal slot 16 of a respective longitudinal projection 15 of the block 10. It should be understood that the holes 71 can be provided with an inner thread, to retain the threaded body of a respective screw 17, or be only dimensioned for housing the body of a single screw disposed through said holes and associated with a tightening nut.

Thus, the base body 70 can be displaced, linearly, in the direction of the longitudinal axis of the resonant spring 50 and, angularly, around the common axis of the two threaded holes 71, which axis is disposed according to a direction simultaneously orthogonal to the axis of the resonant spring 50 and to the axis of the second end portion 50*b* of the latter. This construction allows carrying out the two positioning adjustments (longitudinal linear and angular) of the base body 70 before the final tightening of the screws 17 to immobilize the base body 70 in the block 10.

In the illustrated construction, the base body 70 further incorporates, in its front face 70*b*, a spacer 75 which projects forwards by a predetermined extension, as described ahead.

The intermediate body 80 presents a rear face 80*a*, to be seated against the front face 70*b* of the base body 70, and a front face 80*b*.

The rear face 80*a* can incorporate an orthogonal projection 81, generally in the form of a cylindrical pin, positioned so as to be maintained coaxial or approximately coaxial to the axis of the compression movable assembly, the orthogonal projection 81 being dimensioned to be fitted and guided in the interior of an oblong recess 72 provided in the front face 70*b* of the base body 70. The oblong recess 72 has its longitudinal axis parallel to the common axis of the holes 71. It should be understood that the positions of the orthogonal projection 81 and of the oblong recess 72, in case these elements are effectively provided, can be inverted, that is, the orthogonal projection 81 being incorporated to the front face 70*b* of the base body and the oblong recess 72 being provided in the rear face 80*a* of the intermediate body 80.

This construction allows the intermediate body 80 to be linearly displaced along the front face 70*b* of the base body 70, guided by the latter, in the direction of the common axis of the holes 71, that is, in a direction orthogonal to the axis of the resonant spring 50 and to the diametrical direction of the second end portion 50*b* of the resonant spring 50.

The intermediate body 80 can be also rotated, together with its orthogonal projection 81, around the axis of the latter, that is, around a direction coincident with or parallel to the axis of the compression movable assembly. However, this construction does not allow the intermediate body 80 to be linearly displaced in relation to the base body 70, according to a diametrical direction orthogonal to the longitudinal axis of the oblong recess 72, that is, according to the diametrical direction of the second end portion 50*b* of the resonant spring 50.

The intermediate body 80 further presents, along the whole width of its front face 80*b*, a recess 82 defining a concave cradle, generally with a semi-circular profile, or in any other shape compatible with the cross-sectional contour of the spring wire, as for example in a V-shape, having its axis orthogonal to the axis of the holes 71 of the base body 70 and to the axis of the resonant spring 50. The recess 82 is dimensioned to operate as a cradle in which is seated an extension of the second end portion 50*b* of the resonant spring 50.

Although the figures of the drawings do not illustrate any other construction for the base body 70 and for the intermediate body 80, it should be understood that the latter can be constructed without the orthogonal projection 81, in which case the oblong recess 72 is suppressed from the base body 70. In this case, instead of the second end portion 50*b* of the resonant spring 50 sliding in the recess 82 of the intermediate body 80, it is the latter which slides on the base body 70, according to a diametrical direction coincident with that of the second end portion 50*b* of the resonant spring 50.

The top body 90 has the function of pressing the second end portion 50*b* of the resonant spring 50 against the recess 82 of the intermediate body 80, as well as the latter against the front face 70*b* of the base body 70. For this purpose, the top body 90 is provided with at least two through holes 91, joining a rear face 90*a* with a front face 90*b* of said top body 90 and which are axially aligned to respective threaded holes 73 provided in the base body 70 from its front face 70*b*. Each through hole 91 receives a screw 92 which is affixed in the interior of a respective threaded hole 73 of the base body 70, allowing the top body 90 to be pulled against the base body 70, compressing the second end portion 50*b* of the resonant spring 50 against the intermediate body 80 and the latter against the base body 70. It should be noted that the intermediate body 80 is dimensioned to be positioned between the screws 92, thus being compressed between the base body 70 and the top body 90. The spacer 75 which, in the illustrated embodiment, is frontally incorporated to the base body 70, allows the adjacent screw 92 to be tightened until the spacer 75 actuates against the rear face 90*a* of the top body 90. Thus, the other screw 92 can be tightened to provide the final retention of the second end portion 50*b* of the resonant spring 50, after correctly adjusting the alignment of the resonant assembly in relation to the cylinder 12. Nevertheless, it should be understood that the spacer 75 can be optionally incorporated, in a single piece, to the rear face 90*a* of the top body 90.

With the construction proposed for the second fixation means MF2, it is possible to submit the second end portion 50*b* of the resonant spring 50 to the following positioning adjustments, before the final tightening of the screws 17 of the block 10 and of the screws 92 of the top body 90:

a—axial displacement of the base body 70 (and of the assembly formed by the intermediate body 80, the top body 90, the resonant spring 50 and the compression movable assembly 20,30,40) in relation to the block 10;

b—angular displacement of the base body 70 (and of the second end portion of the resonant spring 50) around an axis coincident with that of the holes 31 of said body and simultaneously orthogonal to the axis of the resonant spring 50 and to the axis of the second end portion 50*b* of the latter;

c—linear displacement of the intermediate body 80 (and of the second end portion 50*b* of the resonant spring 50) in a direction orthogonal to the axis of the resonant spring 50 and parallel to the axis of the holes 71 of the base body 70;

d—angular displacement (rotation) of the intermediate body 80 (and of the resonant spring 50 and of the compression movable assembly 20,30,40) around the axis of the orthogonal projection 81, around the axis of the latter, that is, around a direction coincident with or parallel to the axis of the spring and of the compression movable assembly;

e—linear displacement of the second end portion 50*b* of the resonant spring 50 in the interior of the recess 82 of the intermediate body 80, in the direction of said spring second end portion, upon the existence of the orthogonal projection 81 of the intermediate body 80 fitted in the oblong recess 72 of the base body 70; and f—rotational displacement of the second end portion 50*b* of the resonant spring 50 in the interior of the recess 82 of the intermediate body 80, around the axis of said second end portion 50*b*, which axis is orthogonal to the axis of the resonant spring 50.

It should be noted that, when the orthogonal projection 81 and the oblong recess 72 are suppressed from the intermediate body 80 and base body 70, respectively, the positioning adjustment described above in item "e" is carried out by the intermediate body 80 sliding on the base body 70, according to a diametrical direction coincident with that of the second end portion 50*b* of the resonant spring 50. In this case, it is not the second end portion 50*b* of the resonant spring 50 which slides in the recess 82 of the intermediate body 80, but rather the intermediate body 80 on the base body 70.

The mounting arrangement of the present invention allows that, before the final fixation of the resonant spring 50 to the movable assembly 20, 30, 40 and to the block 10, the resonant spring 50 can have: its first end portion 50*a* moved transversally to the axis of the spring and angularly around the axis of the first end portion 50*a*; and also its second end portion 50*b* moved in the direction of the axis of the resonant spring 50, in two diametrical directions, orthogonal to one another and in relation to the spring axis, as well as angularly around three axes orthogonal to one another, one of them being a diametrical axis of the resonant spring 50, coincident with the second end portion 50*b* of the latter.

This possibility of providing the mounting adjustment of rigid components, which are not subject to the thermo-chemical deterioration, allows providing a concentric mounting of the piston 20 in the interior of the cylinder 12 and of the magnets in relation to the motor M, said concentricity being maintained during the operation of the compressor, minimizing or even preventing impacts of the piston 20 against the inner surface of the cylinder 12. The present mounting arrangement also allows adjusting the relative axial positioning of the piston 20 in relation to the top of the cylinder 12, so as to guarantee a volumetric displacement and refrigeration capacity previously projected for the compressor operation.

The mounting arrangement of the present invention does not require very precise tolerances of the components, both in the direction of the axis of the cylinder 12 and of the resonant spring 50, and in directions orthogonal to one another and to said axis, without compromising the concentric positioning of the movable assembly in relation to the cylinder axis, and the distance from the top of the piston 20 to the valve plate 14 in order to define the displaced volume and the corresponding refrigeration capacity of the compressor.

The invention claimed is:

1. A mounting arrangement for a resonant spring in a linear motor compressor of the type which comprises, in the interior of a shell: a block defining a cylinder; a movable assembly formed by a piston reciprocating in the cylinder, an actuating means and a rod coupling the piston to the actuating means; and a resonant spring having a first and a second end portion which are disposed according to a diametrical direction and attached, respectively, to the movable assembly, in a coaxial manner, by a first fixation means (MF1) and, to the block, by a second fixation means (MF2), characterized in that the second fixation means (MF2) is affixed to the block and to the second end portion of the resonant spring, in an adjustable relative position defined along the displacement of the resonant spring in relation to the block, in three directions orthogonal to one another and defined by the direction of the axis of the resonant spring (I), by the diametrical direction of said second end portion (II), and by the diametrical direction orthogonal to said two directions (III), and also along the angular displacement of the second end portion of the resonant spring around said three directions orthogonal to one another.

2. The mounting arrangement, as set forth in claim 1, characterized in that the second fixation means (MF2) is affixed to the block in a position so as to provide for linear displacement and an angular displacement of said second fixation means (MF2) in relation to the block, respectively, in the direction of the axis of the resonant spring and around an axis diametrical to the resonant spring and orthogonal to the axis diametrical to the resonant spring and to the diametrical direction of said second end portion, the latter being affixed to the second fixation means (MF2) in a position defined along a linear displacement of the resonant spring in the diametrical direction of said second end portion and in a diametrical direction orthogonal to the direction of said second end portion, and along an angular displacement of the resonant spring around said diametrical direction of said second end portion and around the direction of the axis of the resonant spring.

3. The mounting arrangement, as set forth in claim 2, characterized in that the second fixation means (MF2) comprises: a base body attached to the block in a position defined along a linear displacement of the base body and along an angular displacement of the base body, with respect to the direction of the axis of the resonant spring and around an axis diametrical to the resonant spring and orthogonal to the diametrical direction of said second end portion; an intermediate body seated against the base body, so as to be displaced, linearly, in a diametrical direction orthogonal to the direction of said second end portion and, angularly, around the direction of the axis of the resonant spring, said intermediate body presenting a face opposite to the face to be seated on the base body, on which is seated the second end portion of the resonant spring; and a top body attached to the base body, so as to press the second end portion of the resonant spring against said opposite face of the intermediate body and the latter against the base body.

4. The mounting arrangement, as set forth in claim 3, characterized in that said opposite face of the intermediate body is provided with a recess in which is seated the second end portion of the resonant spring, said top body being attached to the base body, so as to press the second end portion of the resonant spring in the recess of the intermediate body.

5. The mounting arrangement, as set forth in claim 3, characterized in that the block presents two longitudinal projections diametrically opposite in relation to the cylinder and each presenting a free end provided with a longitudinal slot, said base body presenting opposite end faces, a front face and two coaxial holes, each being provided from an end face, to receive and retain a screw mounted through the slot of a longitudinal projection of the block.

6. The mounting arrangement, as set forth in claim 5, characterized in that the intermediate body presents a rear face, to be seated against the front face of the base body, and a front face, one of the parts of rear face of the intermediate body and of front face of the base body incorporating an orthogonal projection, in the form of a cylindrical pin, to be fitted and guided in the interior of an oblong recess provided in one of the parts defined by the front face of the base body and by the rear face of the intermediate body, said oblong recess having its longitudinal axis parallel to the common axis of the holes and orthogonal to the diametrical direction of the second end portion of the resonant spring.

7. The mounting arrangement, as set forth in claim 6, characterized in that the orthogonal projection is coaxial or approximately coaxial to the axis of the compression movable assembly.

8. The mounting arrangement, as set forth in claim 6, characterized in that the top body presents a rear face and a front face joined to each other by at least two through holes axially aligned to respective threaded holes provided in the base body from its front face, each through hole receiving a screw to be affixed in the interior of a respective threaded hole of the base body.

9. The mounting arrangement, as set forth in claim 8, characterized in that one of the parts defined by the base body and top body incorporates, in its face turned to the other of said parts, a spacer which projects in direction to the other part, to be seated thereon upon tightening of the adjacent screw.

10. The mounting arrangement, as set forth in claim 1, characterized in that the first fixation means (MF1) comprises two bearing portions opposite to each other and each provided with a recess in the form of a concave cradle, in which is partially housed a respective extension of the first end portion of the resonant spring, said bearing portions being incorporated to the actuating means and associated with at least one tightening means, capable of pressing one bearing portion against the other, around the first end portion of the resonant spring.

11. The mounting arrangement, as set forth in claim 10, characterized in that the actuating means comprises a frame in the form of a nipper with two arms, each arm having a base end affixed to the other arm and a free end which carries, in a single piece, a respective bearing portion.

12. The mounting arrangement, as set forth in claim 11, characterized in that each of the bearing portions presents a hole displaced in relation to the adjacent recess and constructed to receive the tightening means in the form of a screw, said holes being disposed according to the same axis orthogonal to the axis of the recess.

13. The mounting arrangement, as set forth in claim 12, characterized in that the resonant spring is formed by two interposed spring wires, with the same diameter and having their adjacent end portions coaxial to each other and disposed according to a diametrical direction orthogonal to the axis of the resonant spring, so as to define, jointly, the first and the second end portion of the resonant spring.

* * * * *